US007677566B2

(12) United States Patent
Krenn et al.

(10) Patent No.: US 7,677,566 B2
(45) Date of Patent: Mar. 16, 2010

(54) PRE-SHUFFLER FOR A PLAYING CARD SHUFFLING MACHINE

(75) Inventors: Peter Krenn, Neufeld (AT); Ernst Blaha, Tullnerbach (AT)

(73) Assignee: Shuffle Master GmbH & Co. KG, Vienna (AT)

( * ) Notice: Subject to any disclaimer, the term of this patent is extended or adjusted under 35 U.S.C. 154(b) by 1268 days.

(21) Appl. No.: 10/644,408

(22) Filed: Aug. 19, 2003

(65) Prior Publication Data

US 2005/0040594 A1 Feb. 24, 2005

(51) Int. Cl.
*A63F 1/12* (2006.01)

(52) U.S. Cl. ..... 273/149 R

(58) Field of Classification Search ..... 273/149 R, 273/149 P

See application file for complete search history.

(56) References Cited

U.S. PATENT DOCUMENTS

| | | | | | |
|---|---|---|---|---|---|
| 3,944,230 | A * | 3/1976 | Fineman | 273/149 R |
| 4,586,712 | A | 5/1986 | Lorber et al. | 273/149 R |
| 5,356,145 | A * | 10/1994 | Verschoor | 273/149 R |
| 5,695,189 | A | 12/1997 | Breeding et al. | 273/149 R |
| 6,019,368 | A * | 2/2000 | Sines et al. | 273/149 R |
| 6,068,258 | A | 5/2000 | Breeding et al. | 273/149 R |
| 6,139,014 | A | 10/2000 | Breeding et al. | 273/149 R |
| 6,149,154 | A | 11/2000 | Grauzer et al. | 273/149 R |
| 6,267,248 | B1 * | 7/2001 | Johnson et al. | 209/547 |
| 6,325,373 | B1 * | 12/2001 | Breeding et al. | 273/149 R |
| 6,403,908 | B2 * | 6/2002 | Stardust et al. | 209/587 |
| 6,588,750 | B1 * | 7/2003 | Grauzer et al. | 273/149 R |
| 6,655,684 | B2 * | 12/2003 | Grauzer et al. | 273/149 R |
| 6,659,460 | B2 * | 12/2003 | Blaha et al. | 273/149 R |
| 6,676,127 | B2 * | 1/2004 | Johnson et al. | 273/149 R |
| 6,889,979 | B2 * | 5/2005 | Blaha et al. | 273/149 R |
| 2003/0075866 | A1 * | 4/2003 | Blaha et al. | 273/149 R |
| 2005/0040594 | A1 * | 2/2005 | Krenn et al. | 273/149 R |

OTHER PUBLICATIONS

U.S. Appl. No. 10/009,411, filed Dec. 10, 2001.
U.S. Appl. No. 10/256,639, filed Sep. 27, 2002.
U.S. Appl. No. 10/256,880, filed Sep. 27, 2002.

* cited by examiner

*Primary Examiner*—Gene Kim
*Assistant Examiner*—Dolores Collins
(74) *Attorney, Agent, or Firm*—Mark A. Litman & Associates, P.A.

(57) ABSTRACT

The invention comprises a pre-shuffler that receives a quantity of cards to be shuffled, such as nine decks of cards. One embodiment of the pre-shuffler includes a horizontal moveable box having, for example, nine compartments with vertical walls for separating the cards to be shuffled into groups. Cards are placed into all or some of the compartments in the box, and a shuffling sequence is then commenced. A motor moves the box containing the cards so that the cards in the first compartment are deposited into an input tray of the main card shuffler. The main shuffler then forwards the cards in the input tray one by one, via rollers, to selected card receptacles in the main shuffler. The process is then continued for each group of cards in the pre-shuffler until all cards are in the main shuffler. The main shuffler then shuffles the cards in a normal fashion. The cards output from the main shuffler are in a more random order than had the cards not been pre-shuffled by the pre-shuffler.

29 Claims, 1 Drawing Sheet

PRE-SHUFFLER FOR A PLAYING CARD SHUFFLING MACHINE

FIELD OF THE INVENTION

This invention relates to playing card shufflers and, in particular, to a device for loading cards into a shuffler.

BACKGROUND

Many types of playing card shufflers are known. One type of known shuffler includes a rotatable wheel having slots, where the wheel is rotated by a stepper motor. One or more decks of cards are placed into an input tray, and rollers forward cards into selected slots in the wheel. A microprocessor controls the stepper motor to align a selected slot with the card path. After the cards are loaded into the wheel, the microprocessor then controls the stepper motor to align randomly selected slots of the wheel with an output mechanism that discharges the cards from the slots into an output tray. The cards in the output tray may be dealt to the players as the cards are output from the wheel, or the dealer may wait until the entire contents of the wheel are discharged and then place the shuffled cards into a shoe for dealing to the players.

Another common shuffler randomly removes cards from a vertical stack of cards and places the removed cards in a separate stack. The stacks are then repeatedly combined and separated until the cards are shuffled. Another form of shuffler uses a vertical rack of compartments and places the cards into randomly selected compartments.

Additional shufflers are known. Examples of shufflers are described in U.S. patent application Ser. Nos. 10/009,411; 10/256,639; and 10/256,880, all by Ernst Blaha and Peter Krenn; and U.S. Pat. Nos. 6,267,248; 6,149,154; 5,695,189; 6,139,014; 6,068,258; 6,325,373; 6,019,368; and 4,586,712. These U.S. applications and patents are incorporated herein by reference.

In these various automatic shufflers, shuffling may not be truly random since the order of cards placed in the shuffler may have some effect on the final order of the shuffled cards. What is needed is a technique for further randomizing the cards output by an automatic card shuffler.

SUMMARY

In one embodiment, the invention comprises a pre-shuffler that receives a quantity of cards to be shuffled, such as nine decks of cards. Many types of games use multiple decks of cards to deter card counting, such as blackjack, baccarat, punto blanco, and derivatives of such games.

One embodiment of the pre-shuffler includes a horizontal moveable box having, for example, nine compartments with vertical walls for separating the cards to be shuffled into groups. Cards are placed into all or some of the compartments in the box, and a shuffling sequence is then commenced.

A stepper motor moves the box containing the cards so that the cards in the first compartment are deposited into an input tray of a main card shuffler. The main shuffler then forwards the cards from the input tray one by one, via rollers, to selected compartments in the main shuffler. Any form of main shuffler may be used including those using wheels, a vertical rack of compartments, or vertical stacks of cards, as previously described. The process is then continued for each group of cards in the pre-shuffler until all cards are in the main shuffler. The main shuffler then shuffles (randomizes) the cards in a normal fashion.

In one embodiment, the top card in a group of cards deposited by the pre-shuffler into the input tray of the main shuffler was the card adjacent the next compartment in the pre-shuffler, and this top card is the first of the group to be forwarded into the main shuffler. This changes the order of the cards forwarded into the main shuffler as compared to the prior art process of directly placing a stack of all the cards to be shuffled into the main shuffler.

In one embodiment, the main shuffler is a wheel having slots (card receptacles). All cards to be shuffled are inserted into the slots in any sequence, with any number of cards placed into each slot. The main shuffler then performs a randomizing procedure on the cards by, for example, randomly selecting a slot and rotating the wheel so that the randomly selected slot is aligned with an output path. The cards are then output from the slot to an output tray. A next slot is then randomly selected, and the cards output from the slot are then placed on top of or underneath the cards that have previously been ejected. When all or a portion of the cards in the main shuffler have been ejected, the dealer may then deal the shuffled cards. The cards output from the main shuffler are in a more random order than had the cards not been pre-shuffled by the pre-shuffler.

In one embodiment, the stack of shuffled cards is removed from the shuffler and placed in a conventional dealing shoe for dealing to the players.

The pre-shuffler or main shuffler may also be equipped with a playing card reader to detect the rank and suit of each card forwarded to the main shuffler. This may be used to verify that no cards have been removed or added.

DETAILED DESCRIPTION

Figure 1:
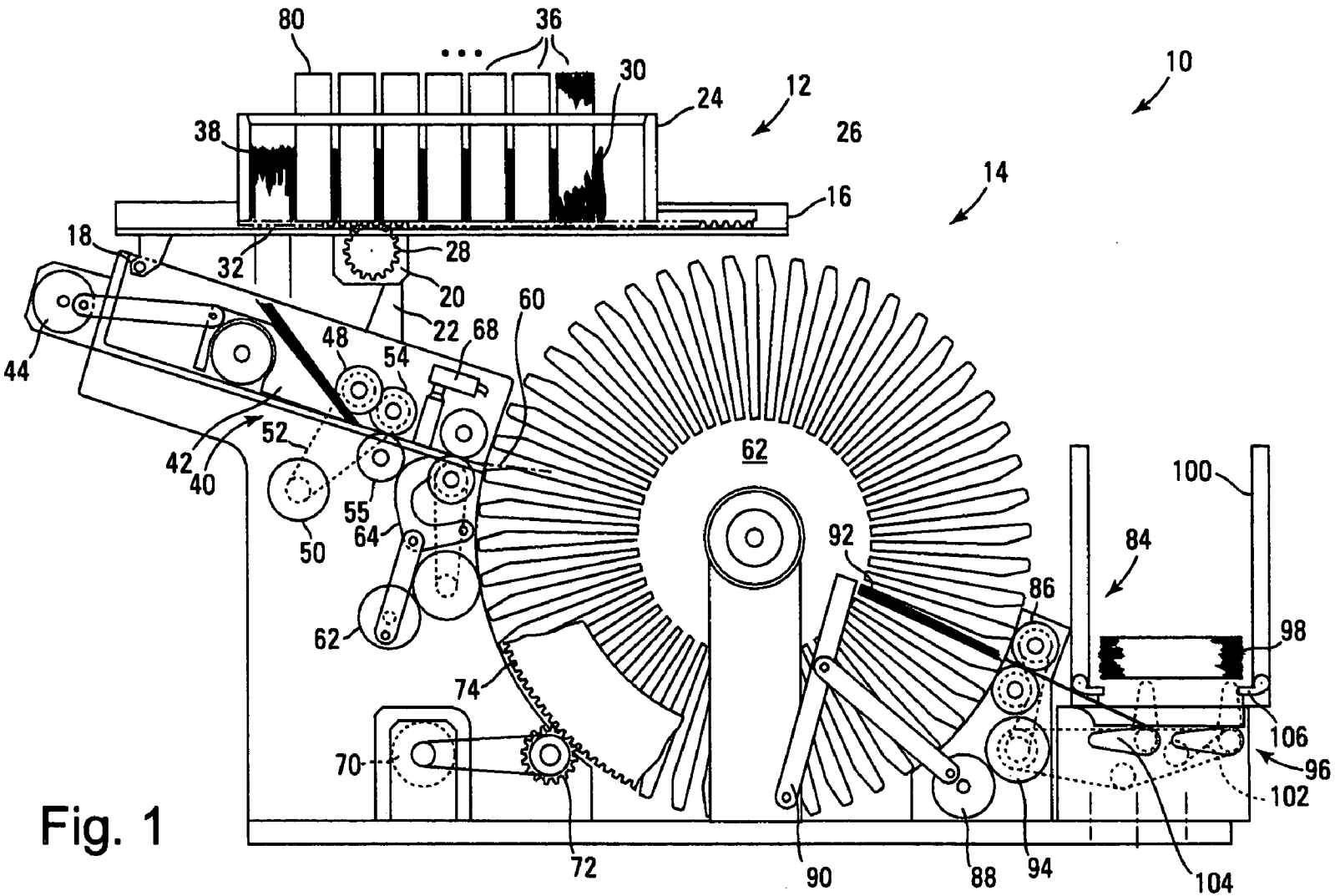
FIG. 1 is a side view of one embodiment of the pre-shuffler and main shuffler.

FIG. 1 illustrates a playing card shuffler 10 comprising, in combination, a pre-shuffler 12 and a main shuffler 14.

The pre-shuffler 12 includes a horizontal support platform 16 connected to the main shuffler 14 by a hinge 18. Platform 16 is supported in its horizontal position by a tab 20, extending from the bottom of platform 16, resting on a tab support 22, forming part of the main shuffler 14. The hinge allows the pre-shuffler 12 to be lifted out of its position shown in FIG. 1 so that the main shuffler 14 may be used in its conventional manner or to gain access to parts for maintenance.

A card input box 24 is supported by platform 16 so that box 24 may slide along platform 16. The bottom of box 24 includes a rack having a linear array of teeth 26 that engage a pinion 28 rotated by a conventional stepper motor (obscured by pinion 28). The stepper motor is controlled by a conventional motor control circuit that counts the number of pulses applied to the stepper motor to determine the angular rotation of the stepper motor axle. Such stepper motors and their controls are commercially available and need not be described. Accordingly, the card input box 24 is movable horizontally along platform 16.

Box 24 includes vertical walls 30, forming card compartments within box 24. In the embodiment of FIG. 1, there are eight vertical walls 30 to form nine card compartments in box 24. Any number of compartments within box 24 provides a degree of pre-shuffling. For example, the number of compartments may be five or greater. Each compartment may hold 52 cards or any other number of cards.

After the dealer has determined that the cards in a game need to be shuffled, the dealer forms a stack of the cards. Generally, there are nine or less card decks used in conventional casino card games, such as blackjack. The dealer then separates the large stack of cards into nine or less groups and places these groups in any order within the compartments in box 24. In one embodiment, the dealer simply places the cards in the compartments in the order of the unshuffled stack of cards.

The cards are now ready to be applied to the main shuffler 14 for complete shuffling. The stepper motor controlling pinion 28 is rotated to align the first compartment of the box 24 with an opening 32 in platform 16. The walls 30 in box 24 are supported by sidewalls (not shown) of box 24, and box 24 has no bottom. Thus, the cards 36 slide along the top surface of platform 16. When a group of cards (e.g., group 38) is aligned over opening 32, the group of cards falls into an input tray 40 of the main shuffler 14. Although any type of main shuffler 14 may be used, the operation of one type of shuffler 14 is described below for completeness.

Once the cards in a compartment have fallen through opening 32 and into the input tray 40, the cards are supported by a wedge 42. A cam 44 is rotated to move wedge 42 so that the top card in the group is in contact with rubber roller 48. Pulley 50 is then rotated such that band 52 rotates roller 48 in a counterclockwise direction to forward the top card in the group of cards to pinch rollers 54 and 55, also driven by band 52.

This top card is then further forwarded by downstream rollers and to a compartment 60 in rotatable wheel 62. Wheel 62 is then rotated to align a different wheel compartment with the input card path. To rotate wheel 62, a stepper motor 70 rotates a pinion 72 that meshes with gears 74 on the periphery of the wheel 62 to align the selected compartment with the input tray 40. A microprocessor keeps track of the compartments filled and may control the voltage polarity to the stepper motor 70 to rotate the wheel 62 in either direction depending upon the most efficient direction to align a chosen compartment with the input path. The wheel compartments may be filled in sequence or at random.

This process of forwarding each of the cards in the input tray 40 one by one is continued until all the cards in the input tray 40 are loaded into selected wheel compartments. As each card is being loaded, a cam 62 pivots a pusher arm 64 to push each card completely into a compartment.

A sensor 68 senses each card forwarded past the sensor to detect when the card has completely passed the input portion and has entered a wheel compartment. Sensor 68 may be an optical sensor that simply detects that light has been blocked by a card. After a card has passed sensor 68, the pusher arm 64 is triggered. If light has not been blocked by a card for a predetermined time, it is assumed that there are no further cards in the input tray 40, and a next group of cards must be delivered by the pre-shuffler 12. A microprocessor detects the sensor signal and controls the various stepper motors and other events in accordance with a program stored in a memory.

The stepper motor that rotates pinion 28 in the pre-shuffler 12 is energized to move the box 24 so that the next group of cards is aligned with opening 32 and drops through onto wedge 42. The process of transporting the cards one by one from the input tray 40 into selected compartments of wheel 62 is then performed.

Note that the rightmost card in the first group of cards 38 that is adjacent the second group of cards 80 in box 24 is the first card of the group to be forwarded to a compartment in wheel 62. The separation into card groups by the pre-shuffler effectively flips the order of each group of cards in box 24 around to provide a degree of pre-shuffling before the cards even enter wheel 62. Thus, the cards are pre-shuffled even before being deposited into the wheel compartments.

Once all the cards in the pre-shuffler 12 have been loaded into wheel 62, a microprocessor determines the random order of compartments to align with the output portion 84 of the main shuffler 14. When a compartment is aligned with output rollers 86, a cam 88 is rotated to cause a pusher arm 90 to pivot and push out the entire group of cards 92 in a compartment to pinch rollers 86. Rollers 86, being rotated by pulley 94, forward the group of cards to an output tray 100 of the shuffler 14.

The cards 98 already in the output tray 100 are lifted up by cams 102 and 104, driven by pulley 94. The upward-moving cards 98 pivot traps 106 in an upward direction until traps 106 fall back into place in the position shown in FIG. 1. As cams 102 and 104 are then removed from the stack of cards 98, the stack of cards then rests on the top of traps 106, leaving an opening for a new group of cards 92 to be inserted beneath the stack.

This output process is then repeated for all wheel compartments until all the cards have been placed in the output tray 100.

The dealer or other operator may then remove the stack of cards and put them in a conventional dealing shoe for dealing to the players. In another embodiment, each group of cards output from a compartment is deposited in an output shoe for the dealer to deal those cards.

Further pre-shuffling may be performed by the stepper motor rotating pinion 28 to randomly align a group of the cards in the pre-shuffler with opening 32. Opening 32 may include a shutter for only opening when the chosen group is aligned with the opening 32. Other ways of randomizing the order of the groups of cards deposited into the main shuffler 14 are also envisioned. One embodiment may include a pusher for pushing a selected group of cards through opening 32 when that randomly selected group of cards is aligned with opening 32.

The pre-shuffler portion 12 may be connected to any type of shuffler and can be easily modified to adapt to the input trays of all types of shufflers.

Accordingly, the pre-shuffler increases the randomness of the shuffled cards.

Having described the invention in detail, those skilled in the art will appreciate that, given the present disclosure, modifications may be made to the invention without departing from the spirit of the inventive concepts described herein. Therefore, it is not intended that the scope of the invention be limited to the specific embodiments illustrated and described.

What is claimed is:

1. A device for shuffling cards comprising: a pre-shuffler; and a main shuffler, the pre-shuffler comprising: a plurality of compartments for holding groups of playing cards to be shuffled; and an output portion of the pre-shuffler, the output portion delivering one group of cards at a time to an input portion of the main shuffler, the pre-shuffler delivering groups of cards to on input portion of the main shuffler in a different order than an order inputted into the pre-shuffler, each group of cards being input separately as an entire group, so the main shuffler rearranges the order of cards input into the main shuffler and outputting cards in a substantially random order.

2. The device of claim 1 wherein the pre-shuffler comprises an input card holder segmented into the compartments, the card holder supporting the cards on their edges.

3. The device of claim 1 wherein the pre-shuffler comprises an input card holder segmented into the compartments, the card holder being moveable with respect to the input portion of the main shuffler for delivering one group of cards at a time to the input portion of the main shuffler.

4. The device of claim 3 wherein the input card holder is moved substantially horizontally by a motor drive to position a group of cards with respect to the input portion of the main shuffler.

5. The device of claim 1 wherein the pre-shuffler comprises an input card holder segmented into the compartments, wherein a group of cards in the pre-shuffler is positioned with respect to the input portion of the main shuffler for allowing the group of cards to be deposited into the input portion of the main shuffler.

6. The device of claim 5 further comprising a platform supporting the input card holder, the platform having an opening, the holder being movable relative to the platform to allow a group of cards to be moved over the opening so as to fall through the opening and be delivered to the input portion of the main shuffler.

7. The device of claim 6 wherein the input card holder comprises a rack having tooth, the pre-shuffler further comprising a pinion that engages the rack and is rotated to move the card holder relative to the input portion of the main shuffler.

8. The device of claim 1 wherein the compartments comprise five or more compartments.

9. The device of claim 1 wherein the compartments comprise between five and nine compartments.

10. The device of claim 1 wherein each compartment holds at least 52 cards.

11. The device of claim 1 wherein the input portion of the main shuffler comprises an input tray of the main shuffler.

12. The device of claim 1 wherein the input portion of the main shuffler comprises an input tray, the main shuffler further comprising rotating rollers for forwarding one card at a time from a top of a group of cards in the input fray to a randomizer.

13. The device of claim 1 wherein the input portion of the main shuffler comprises an input fray, the main shuffler further comprising rotating rollers for forwarding one card at a time from a top of a group of cards in the input tray to selected card receptacles in a randomizer.

14. The device of claim 13 wherein the main shuffler comprises a plurality of card receptacles, the plurality of card receptacles being moveable relative to the input portion of the main shuffler and an output portion of the main shuffler, the main shuffler comprising a controllable drive for aligning card receptacles in a certain sequence with respect to the input portion of the main shuffler for receiving cards from the input portion, the drive randomly controlling the positioning of the card receptacles wit respect to the output portion of the main shuffler, the output portion of the main shuffler receiving one or more cards from a card receptacle aligned with the output portion.

15. The device of claim 14 wherein the output portion of the main shuffler receives all cards from a card receptacle before the card receptacles are moved to align another card receptacle with the output portion of the main shuffler.

16. A device for shuffling cards comprising:

a pre-shuffler and a main shuffler, the pre-shuffler comprising:

a plurality of compartments for holding groups of playing cards to be shuffled;

an output portion of the pre-shuffler, the output portion delivering one group of multiple playing cards at a single time, without shuffling cards in the one group, to an input portion of the main shuffler, the main shuffler being capable of rearranging the order of the groups of multiple cards input into the main shuffler and for outputting cards in a substantially random order.

17. The device of claim 16 wherein the pre-shuffler comprises an input card holder segmented into the compartments, the card holder supporting the cards on their edges.

18. The device of claim 16 wherein the pre-shuffler comprises an input card holder segmented into the compartments, the card holder being moveable with respect to the input portion of the main shuffler for delivering one group of cards at a time to the input portion of the main shuffler.

19. The device of claim 18 wherein the input card holder is moved substantially horizontally by a motor drive to position a group of cards with respect to the input portion of the main shuffler.

20. The device of claim 16 wherein the pre-shuffler comprises an input card holder segmented into the compartments, wherein a group of cards in the pre-shuffler is positioned with respect to the input portion of the main shuffler for allowing to group of cards to be deposited into the input portion of the main shuffler.

21. The device of claim 20 further comprising a platform supporting the input card holder, the platform having an opening, the holder being movable relative to the platform to allow a group of cards to be moved over the opening so as to fall through the opening and be delivered to the input portion of the main shuffler.

22. The device of claim 21 wherein the input card holder comprises a rack having teeth, the pre-shuffler further comprising a pinion that engages the rack and is rotated to move the card holder relative to the input portion of the main shuffler.

23. The device of claim 16 wherein the compartments comprise five or more compartments.

24. The device of claim 16 wherein each group is randomly selected for delivery to the input portion of the main shuffler.

25. The device of claim 16 wherein groups of cards are delivered to the input portion of the shuffler sequentially.

26. A device for shuffling cards comprising:

a platform of compartments; and a main shuffler, the platform of compartments comprising: a plurality of compartments for holding groups of playing cards in each compartment of the platform to be shuffled; and an output portion of the platform of compartments, the output portion delivering one group of cards at a time to an input portion of the main shuffler, the main shuffler for rearranging the order of cards input into the main shuffler from the platform of compartments and for outputting cards in a substantially random order, and the output portion selecting single groups of cards within a single compartment to be randomly delivered to the input portion of the main shuffler.

27. The device of claim 26 wherein the platform moves relative to the main shuffler.

28. The device of claim 26 wherein the platform moves the compartments relative to the input portion of the main shuffler.

29. The device of claim 28 wherein the platform aligns compartments in the platform of compartments randomly with the input portion of the main shuffler.

* * * * *